US008645080B2

(12) United States Patent
Nakayama et al.

(10) Patent No.: US 8,645,080 B2
(45) Date of Patent: Feb. 4, 2014

(54) METHOD FOR INSPECTING BOLTS

(75) Inventors: Shin Nakayama, Nagasaki (JP); Masuo Tada, Nagasaki (JP); Tomohiro Numajiri, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 104 days.

(21) Appl. No.: 12/996,313

(22) PCT Filed: Jan. 9, 2009

(86) PCT No.: PCT/JP2009/050597

§ 371 (c)(1), (2), (4) Date: Mar. 15, 2011

(87) PCT Pub. No.: WO2010/079625

PCT Pub. Date: Jul. 15, 2010

(65) Prior Publication Data

US 2011/0166796 A1 Jul. 7, 2011

(51) Int. Cl.
*G01N 31/00* (2006.01)

(52) U.S. Cl.
USPC ..... 702/23; 702/182; 470/8; 470/11; 470/16

(58) Field of Classification Search
USPC ..... 702/23, 182; 470/8, 11, 16
See application file for complete search history.

(56) References Cited

U.S. PATENT DOCUMENTS

| | | | | |
|---|---|---|---|---|
| 4,273,838 | A * | 6/1981 | Biemiller | 428/683 |
| 5,108,699 | A * | 4/1992 | Bodnar et al. | 420/109 |
| 5,357,443 | A * | 10/1994 | Watanbe et al. | 700/147 |
| 6,042,782 | A * | 3/2000 | Murata et al. | 420/109 |

FOREIGN PATENT DOCUMENTS

| | | | |
|---|---|---|---|
| JP | 62-86149 | A | 4/1987 |
| JP | 5-117811 | A | 5/1993 |
| JP | 8-67950 | A | 3/1996 |
| TW | 200300370 | | 6/2003 |
| TW | 200535258 | | 11/2005 |

OTHER PUBLICATIONS

Kruszynska, J.S, "Possible Causes of Embrittlement in 12% Chromium Steels Used for Fossil-Fired Power Stations", 1985, Materials Science and Technology, 1(2) 117-20.*

Noboru Watanabe, "Kanreichi ni Okeru Kyoryoyo Kozai no Riyo Gijutsu ni Tsuite", Current advances in materials and processes vol. 2 (1989) No. 5, Sep. 1, 1989, pp. 1532-1533.

(Continued)

*Primary Examiner* — Jonathan C Teixeira Moffat

*Assistant Examiner* — Stephanie Bloss

(74) *Attorney, Agent, or Firm* — Kanesaka Berner & Partners, LLP

(57) ABSTRACT

A testing method for the bolt to be used under the conditions of excessive wind force by which bolts made of Cr—Mo steel can be separated into a group of bolts usable in cold areas and a group of bolts unusable in cold areas without conducting Charpy impact test involving complicated operation, specifically, a testing method for determining whether bolts made of heat-treated Cr—Mo steel are usable or unusable in cold areas, wherein the determination is conducted on the basis of both J parameter calculated by formula: J=(Si %+Mn %) (P %+Sn %) 104 (wherein P %, Si %, Mn % and Sn % are contents (mass %) of phosphorus (P), silicon (Si), manganese (Mn) and tin (Sn) respectively as disclosed in the inspection certificate of the Cr—Mo steel) and bolt diameter.

5 Claims, 3 Drawing Sheets

(56) References Cited

OTHER PUBLICATIONS

International Search Report of Application No. PCT/JP2009/050597 mailed Mar. 3, 2009.
International Search Report for PCT/JP2009/050597 issued Aug. 16, 2011.
Taiwan Notice of Allowance—English Version.
Taiwan Notice of Allowance—Taiwanese Version.
Notice of Allowance Dated December 18, 2011 Issued in JP2010-545679 With Translation.
Notice of Allowance Dated June 11, 2012 Issued in KR2010-7028941 With Translation.

* cited by examiner

METHOD FOR INSPECTING BOLTS

RELATED APPLICATIONS

The present application is based on, and claims priority from, International Application Number PCT/JP2009/079625, filed Jan. 9, 2009, the disclosure of which is hereby incorporated by reference herein in its entirety.

FIELD OF THE INVENTION

The present invention relates to an inspection method for inspecting bolts, especially the bolts that are to-be-used for a wind turbine installed in cold climate areas; thereby, in the inspection method, it can be estimated whether or not the bolt as an object of the inspection can be used for the wind turbine.

BACKGROUND OF THE INVENTION

The bolts used for the wind turbine for wind power generation need to be of high strength and of sufficient toughness. Hence, as a steel material of the bolt used for the wind turbine, the chromium molybdenum steel that is of high strength and of sufficient toughness is often used. The chromium molybdenum steel is special alloy steel made from iron (Fe), carbon (C), chromium (Cr) and molybdenum (Mo); namely, the chromium molybdenum steel has the material contents, chromium (Cr) and molybdenum (Mo) in the carbon steel (Fe+C) that includes carbon (C) beside the base content iron (Fe); adding the chromium elements to steel improves the hardenability thereof; adding the molybdenum elements to steel further improves the hardenability thereof; moreover, in a tempering process, the chromium molybdenum steel is less prone to being softened and embrittled.

An example of contents as to the chromium molybdenum steel as a material of the bolts used for the wind turbine is now explained with respect to the percentage of contents [in mass %]; the chromium molybdenum steel includes:

carbon (C) content of more than or equal to 0.33% and less than or equal to 0.38%, silicon (Si) content of more than or equal to 0.15% and less than or equal to 0.35%, manganese (Mn) content of more than or equal to 0.60% and less than or equal to 0.85%, chromium (Cr) content of more than or equal to 0.90% and less than or equal to 1.20%, molybdenum (Mo) content of more than or equal to 0.15% and less than or equal to 0.30% or more than 0.30%, phosphorus (P) content of less than or equal to 0.03%, and sulfur (S) content of less than or equal to 0.03%.

The bolt made of the chromium molybdenum steel has sufficient strength and toughness; thus, there is no special problem in using the bolt for the wind turbine installed in the non-cold climate areas.

On the other hand, in a case of a wind turbine installed in the cold climate area where the ambient temperature becomes as low as minus 40° C., it is required that Charpy impact strength of the material of the bolt used for the wind turbine be equal to or more than 27 [J] as an index of the material toughness with respect to the condition of minus 20° C. However, it is known that, out of a plurality of bolts made of the chromium molybdenum steel, some bolts show Charpy impact strength of more than or equal to 27 [J] as the index of the material toughness with respect to the condition of minus 20° C., while some bolts show Charpy impact strength of less than 27 [J] as the index of the material toughness with respect to the condition of minus 20° C.; namely, in a case where a plurality of chromium molybdenum steel bolt is manufactured, Charpy impact strength for some of the bolts does not meet the Charpy impact strength requirement of equal to or more than 27 [J] as an index of the material toughness with respect to the condition of minus 20° C. Hence, the chromium molybdenum steel bolts that do not satisfy the Charpy impact strength requirement cannot be used as the bolts to be used for the wind turbine installed in cold climate areas.

For the reasons as described above, it is sometimes considered to use a steel material other than chromium molybdenum steel for the bolts to be used in the wind turbine installed cold climate areas; thereby, the material as a substitute of chromium molybdenum steel having the property of a high Charpy impact strength at the lower temperature, namely, the property of higher low-temperature toughness.

The patent reference 1 (JP1996-67950) discloses a martensitic stainless steel with excellent strength and toughness; naturally, this martensitic stainless steel can be used as a material of the high low-temperature toughness. The martensitic stainless steel includes:

carbon (C) content of more than or equal to 0.05% and less than or equal to 0.15% [in mass %], silicon (Si) content of less than or equal to 2% [in mass %], manganese (Mn) content of less than or equal to 2% [in mass %], and chromium (Cr) content from 10% to 20% [in mass %].

Further, in the crystal structure matrices of the martensitic stainless steel, the martensitic stainless steel includes fine carbides of particle size smaller than 2 micron-meters, the fine carbide being homogeneously dispersed in the matrices, in a volume percentage of 1 to 30%; thereby, the original austenite grain size of the material is refined into smaller than or equal to 30 micron-meters. In this way, the toughness of the martensitic stainless steel is improved.

However, in order to produce the martensitic stainless steel that is disclosed in the patent reference 1, a plenty amount of chromium has to be added in the crystal structure; thereby, the precipitation and growth of ferrous temper carbide that enhances the strength of the material of the bolt steel cannot be easily expected; thus, it is difficult to increase the strength of the material proposed in the patent reference 1. Hence, it is difficult to use the proposed material as the bolt material in relation to the wind turbine installed in cold climate areas.

Further, if a material to be usable for the bolt of the wind turbine installed in cold climate areas is used together with the chromium molybdenum steel as a material of the bolt for the wind turbine installed in non-cold climate areas, then it becomes necessary to manufacture the two kinds of materials in separated facilities; hence, the initial cost as well as the running expense increases.

Thus, the background described thus far may bring an idea to classify the bolts made of the chromium molybdenum steel into two categories; the first one is the category of the bolts that are usable as the bolt of the wind turbine installed in cold climate areas, and the second one is the category of the bolts that are unusable as the bolt of the wind turbine installed in cold climate areas; thereby, the criterion of the classification is whether or not the Charpy impact strength as to the material of each bolt is more than or equal to the Charpy impact value 27 [J] (at minus 20° C.), the value 27 [J] as a threshold being derived from the requirement regarding the bolts to be used for the wind turbine installed in cold climate areas.

In order to perform the classification of the bolts, for instance, it may be considered to sample a bolt per each production lot of the chromium molybdenum steel bolts so as to perform Charpy impact test as to the sampled bolt; if the Charpy impact value as to the sampled bolt satisfies the criterion, then the bolts belonging to the production lot are regarded as being usable for the cold climate condition; if not, the bolts belonging to the production lot are regarded as being unusable for the cold climate condition.

In this way, it becomes unnecessary to produce the two kinds of steel materials for the cold climate condition and the non-cold climate condition in separated facilities; thus, the two kinds steel materials for the cold and non-cold climate conditions can be prepared without increasing the initial cost and the running expense.

On the other hand, in a Charpy impact test, a test piece of a right prism shape with a notch is tested whereby the test piece is broken by a high-speed impact; on the basis of the impact energy needed to break the test piece, the toughness of the test piece is evaluated. Accordingly, in order to perform a Charpy impact test, the sampled bolt sampled out of the production lot of the bolts has to be cut so as to manufacture the test piece of the prism shape; thus, complicated and time-consuming work is required in preparing the test piece. Hence, performing the Charpy impact test for the chromium molybdenum steel bolts and classifying the chromium molybdenum steel bolts into two classes (i.e. the usable bolt and the unusable bolt for the cold climate condition) on the basis of the result of the Charpy impact test require the work for hours; and, the complicated work processes become necessary.

Moreover, there is another problem; according to the above-described approach in which whether or not the manufactured chromium molybdenum steel bolts are usable for the cold climate condition by use of the Charpy impact test, the judgment as to whether or not the bolts of the lot are usable cannot be made until the Charpy impact test is finished. Further, since the ratio of the number of the usable bolts to the number of the whole manufactured bolts is not clear before the Charpy impact test is performed, it cannot be judged whether or not a necessary number of the bolts that are usable for the cold climate is prepared; in some cases, a necessary number of the bolts cannot be prepared in time for the construction work of the wind turbine.

DISCLOSURE OF THE INVENTION

In view of the problems as described above, the present invention aims at providing a bolt inspection method for inspecting the bolt made of chromium molybdenum steel whereby it can be judged whether or not the bolt is usable in the wind turbine installed in cold climate areas, without performing Charpy impact tests accompanying intricate work processes.

In order to solve the problems described above, the present invention aims at providing a bolt inspection method for inspecting the bolt made of chromium molybdenum steel, thereby the bolt is manufactured through heat treatment process and it is judged whether or not the bolt is usable for a cold climate condition, the method comprising the steps of:

calculating J parameter that is expressed in a formula, $J=(Si\ \%+Mn\ \%)\times(P\ \%+Sn\ \%)\times10^4$, whereby Si %, Mn %, P %, and Sn % denote the silicon percentage content, the manganese percentage content, the phosphorus percentage content, and the tin percentage content in mass %, respectively, each percentage content in the chromium molybdenum steel being described in the steel material inspection certificate, and judging whether or not the bolt is usable for a cold climate condition, by use of the calculated J parameter and the diameter as a typical length of the bolt.

Hereby, it is noted that the steel material inspection certificate means a certificate that is issued by the manufacturer of the steel material and certifies the inspection record regarding the steel material; and, in the certificate, the data of the percentage contents (in mass %) as to the elements including at least four elements, namely, silicon (Si), manganese (Mn), phosphorus (P) and tin (Sn) have to be described.

On the other hand, whether or not the bolt (raw material) is usable for the cold climate use is judged by evaluating the Charpy impact value of the bolt material (the raw material supplied by steel material manufacturer of the bolt) as an index of the material toughness.

The inventors of the present invention reveal that the J parameter expressed in an equation (described later) and the diameter of the bolt can be an index of the Charpy impact value for the material, that is, the supplied chromium molybdenum steel as to the bolt; and, the inventors find that whether or not the bolt (raw material) is usable for the cold climate condition can be judged on the basis of the J parameter and the diameter of the bolt.

By judging whether or not the bolt is usable for the cold climate condition on the basis of the J parameter and the diameter of the bolt, the time-consuming Charpy impact test that includes complicated processes can be dispensed with; accordingly, the bolt inspection time can be reduced and the series of the work processes can be simplified.

Further, in calculating the J parameter, the values regarding the silicon (Si) percentage content, the manganese (Mn) percentage content, the phosphorus (P) percentage content and the tin (Sn) percentage content in mass % are used, thereby the values are described in the steel material inspection certificate; accordingly, from a bolt manufacturer's standpoint, the analysis of the steel material components can be dispensed with. Hence, The J parameter can be calculated in a shorter time.

A preferable embodiment of the above-disclosed invention is the bolt inspection method, further comprising:

calculating an upper-limit regarding the J parameter, in relation to a maximum diameter regarding the bolts that are used under the cold climate condition, and judging whether or not each bolt is usable for the cold climate condition, on the basis of the condition that the J parameter of each bolt is smaller than or equal to the upper-limit and the diameter of each bolt is smaller than or equal to the diameter size D.

When the maximum diameter regarding the bolts is specified, whether or not each bolt is usable for the cold climate condition can be judged on the basis of the calculated J parameter. Thus, the bolt inspection time can be further reduced.

Further, the diameter of each bolt becomes unimportant if only the maximum diameter of the bolts is known; namely, the diameter of each bolt is not used in judging whether or not each bolt is usable for the cold climate condition. Moreover, since the J parameter can be calculated by the data (regarding the silicon (Si) percentage content, the manganese (Mn) percentage content, the phosphorus (P) percentage content and the tin (Sn) percentage content) that are described in the steel material inspection certificate; in other words, in view of material toughness, whether or not each bolt is usable for the cold climate condition can be judged (simply) at the time point of the procurement of the bolt steel material.

Another preferable embodiment is the bolt inspection method, the heat treatment process comprising hardening process; wherein the upper-limit regarding the J parameter in a case of the hardening process with rapid cooling in water is established differently from the upper-limit regarding the J parameter in a case of the hardening process with rapid cooling in oil.

The cooling speed in the steel hardening with rapid cooling in water is higher than the cooling speed in the steel hardening with rapid cooling in oil; accordingly, the bolt material hardened with rapid cooling in water has a greater toughness value, namely, a greater Charpy impact value than the bolt material hardened with rapid cooling in oil. By establishing different upper-limits regarding the material hardened with rapid cooling in water and the material hardened with rapid cooling in oil, it can be further precisely judged whether or not each bolt is usable for the cold climate condition.

As described above, according to the present invention, a bolt inspection method for inspecting the bolt made of chromium molybdenum steel whereby it can be judged whether or not the bolt is usable for the cold climate condition, without performing Charpy impact tests accompanying intricate work processes; namely the bolts can be classified into the cold climate use and the non-cold climate condition.

BRIEF DESCRIPTION OF THE DRAWINGS

The present invention will now be described in greater detail with reference to the preferred embodiments of the invention and the accompanying drawings, wherein.

DETAILED DESCRIPTION OF THE PREFERRED EMBODIMENTS

Figure 1:
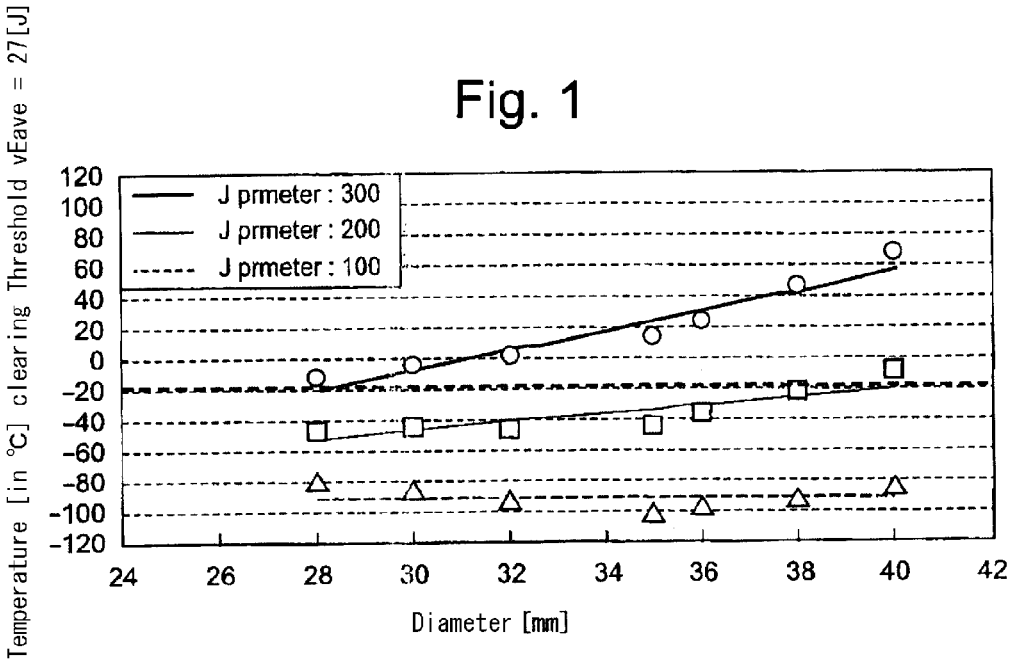
FIG. 1 shows the environmental temperature at which the Charpy impact value for the material of the bolt reaches the criterion value ($vE_{ave}$=27 [J]) thereby the lateral axis represents the typical length as to the physique of the bolt; the vertical axis represents the environmental temperature regarding the criterion value ($vE_{ave}$=27 [J]); characteristic lines are drawn in the figure, each characteristic line corresponding to a J parameter, each characteristic line showing the relation between the physique of the bolt and the environmental temperature regarding the criterion value ($vE_{ave}$=27 [J]), the bolt being manufactured through oil quenching in the event of hardening.

Hereafter, the present invention will be described in detail with reference to the embodiments shown in the figures. However, the dimensions, materials, shape, the relative placement and so on of a component described in these embodiments shall not be construed as limiting the scope of the invention thereto, unless especially specific mention is made.

The inventors of the present invention have made researches on the factors that have effects on the Charpy impact values of the material of the bolt made of chromium molybdenum steel, the contents [in mass %] of the material being:

carbon (C) content of more than or equal to 0.33% and less than or equal to 0.38%, silicon (Si) content of more than or equal to 0.15% and less than or equal to 0.35%, manganese (Mn) content of more than or equal to 0.60% and less than or equal to 0.85%, chromium (Cr) content of more than or equal to 0.90% and less than or equal to 1.20%, molybdenum (Mo) content of more than or equal to 0.15% and less than or equal to 0.30% or more than 0.30%, phosphorus (P) content of less than or equal to 0.03%, and sulfur (S) content of less than or equal to 0.03%.

The result of the researches reveals that the J parameter expressed in the following equation (1) can be an index of the Charpy impact value for the material, that is, the chromium molybdenum steel of the bolt;

$$J=(\text{Si }\%+\text{Mn }\%)\times(\text{P }\%+\text{Sn }\%)\times 10^4 \quad (1),$$

whereby Si %, Mn %, P %, and Sn % denote the silicon percentage content, the manganese percentage content, the phosphorus percentage content, and the tin percentage content in mass %, respectively.

Practically, the values in the submitted certificate of inspection regarding the bolt material may be used in evaluating the J parameter in the equation (1).

The research contents toward the conclusion that the J parameter can be an index of the Charpy impact value are now explained.

Twenty-one kinds of bolts were prepared for the test; in manufacturing the bolts, the melted chromium molybdenum steel comprising the elements of the above-described percentage content ratios are rolled; after being softened by annealing, the chromium molybdenum steel is elongated so as to form a shape of bolts; then, the chromium molybdenum steel is hardened by heating as well as by rapid cooling in oil; further, after being re-heated and kept at the re-heated temperature for a predetermined time span, the chromium molybdenum steel is tempered by annealing (slow cooling). The twenty-one kinds are as follows:

(7 kinds) J=100, 7 kinds of typical lengths (bolt physiques) 28, 30, 32, 35, 36, 38 and 40 mm;

(7 kinds) J=200, 7 kinds of typical lengths (bolt physiques) 28, 30, 32, 35, 36, 38 and 40 mm;

(7 kinds) J=300, 7 kinds of typical lengths (bolt physiques) 28, 30, 32, 35, 36, 38 and 40 mm;

whereby, the typical length (bolt physique) means the diameter of the shaft part of the bolt.

The test pieces for Charpy impact test were made from the above-described twenty-one kinds of bolts; Charpy impact test were performed with the test pieces. In the research, the temperatures at which the Charpy impact value of each test piece satisfies the criterion (i.e. the temperature condition under which the Charpy impact value $vE_{ave}$ of each bolt reaches 27 [J]) are investigated. As described thus far, the threshold 27 [J] itself comes from the requirement for the bolts used in wind turbine installed in the cold climate areas where the ambient temperature goes down to minus 40° C. In response to this actual low temperature, in the practical Charpy impact test, the criterion is that Charpy impact strength of the material of the bolt used for the wind turbine be equal to or more than 27 [J] as an index of the material toughness with respect to the condition of minus 20° C. And, the result of the research is summarized in FIG. 1.

In FIG. 1, the minimum temperatures at which the Charpy impact value of the test piece from each bolt, which is manufactured through the process of rapid cooling in oil, satisfy the criterion, in response to each J parameter, the temperatures being shown in a relation between the typical length of the bolt (the lateral axis) and the temperature (the vertical axis). In other words, the temperature of the vertical axis is the minimum temperature at which the Charpy impact value of the bolt material reaches the threshold value 27 [J] in Charpy impact value $vE_{ave}$, with respect to the typical length in the lateral axis; thereby, the relation between the temperature and the typical length [in mm] are arranged along each J parameter.

As shown in FIG. 1, it is observed that the minimum temperature tends to increase as the typical length of the bolt becomes greater, along a constant J parameter, thereby the minimum temperature means a temperature at which the Charpy impact value of the test piece from each bolt satisfy the threshold 27 [J] in Charpy impact value $vE_{ave}$.

On the other hand, it is observed that the minimum temperature tends to increase as the j parameter increases when the typical length is kept at a constant value.

It is understood from FIG. 1 that the minimum temperatures for all the bolts which typical lengths are within the interval from 28 to 40 mm are within a range from minus 100° C. to minus 80° C., under the condition that the J parameter is equal to 100; thereby, the minimum temperature being a temperature at which the Charpy impact value of the test piece from each bolt satisfies the threshold $vE_{ave}$=27 [J]. Hence, it can be recognized that the bolts which typical lengths are smaller than or equal to 40 mm are usable for the cold climate condition.

Further, it is understood that the minimum temperatures for the bolts which typical lengths are within the interval from 28 to 38 mm are lower than or equal to minus 20° C., under the condition that the J parameter is equal to 200; thereby, the minimum temperature being a temperature at which the Charpy impact value of the test piece from each bolt satisfies the threshold $vE_{ave}$=27 [J]. Hence, it can be recognized that the bolts which typical lengths are smaller than or equal to 38 mm are usable for the cold climate condition.

In addition, it is understood that the minimum temperatures for all the bolts which typical lengths are within the interval from 28 to 40 mm are higher than minus 20° C., under the condition that the J parameter is equal to 300; thereby, the minimum temperature being a temperature at which the Charpy impact value of the test piece from each bolt satisfies the threshold $vE_{ave}$=27 [J]. Hence, the bolts which typical lengths are greater than or equal to 28 mm are unusable for the cold climate condition.

In the next place, the following twenty-one kinds of bolts were prepared for the test; in manufacturing the bolts, the melted chromium molybdenum steel comprising the elements of the above-described percentage content ratios are rolled; after being softened by annealing, the chromium molybdenum steel is elongated so as to form a shape of bolts; then, the chromium molybdenum steel is hardened by heating as well as by rapid cooling in water; further, after being re-heated and kept at the re-heated temperature for a predetermined time span, the chromium molybdenum steel is tempered by annealing (slow cooling). The twenty-one kinds are as follows:

(7 kinds) J=100, 7 kinds of typical lengths (bolt physiques) 28, 30, 32, 35, 36, 38 and 40 mm;

(7 kinds) J=200, 7 kinds of typical lengths (bolt physiques) 28, 30, 32, 35, 36, 38 and 40 mm;

(7 kinds) J=300, 7 kinds of typical lengths (bolt physiques) 28, 30, 32, 35, 36, 38 and 40 mm;

whereby, the typical length (bolt physique) means the diameter of the shaft part of the bolt.

The manufacturing method regarding the twenty-one kinds of bolts described just above is the same as that regarding the twenty-one kinds of bolts that are used for drawing FIG. 1, except that the former method applies the rapid cooling in oil while the latter method applies the rapid cooling in water, in the hardening process.

The test pieces for Charpy impact test were made from the above-described twenty-one kinds of bolts; Charpy impact test were performed with the test pieces. Also, in this research, the temperatures at which the Charpy impact value of each test piece satisfies the criterion (i.e. the temperature condition under which the Charpy impact value $vE_{ave}$ of each bolt reaches 27 [J]) are investigated. The result of the research is summarized in FIG. 2.

Figure 2:
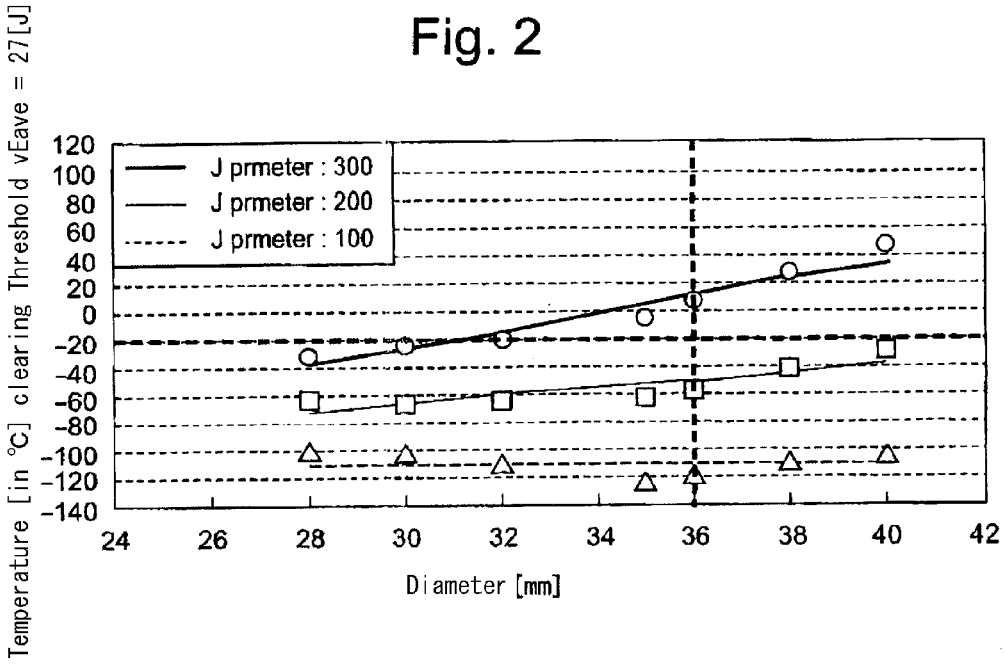
FIG. 2 shows the environmental temperature at which the Charpy impact value for the material of the bolt reaches the criterion value ($vE_{ave}$=27 [J]) thereby the lateral axis represents the typical length as to the physique of the bolt; the vertical axis represents the environmental temperature regarding the criterion value ($vE_{ave}$=27 [J]); characteristic lines are drawn in the figure, each characteristic line corresponding to a J parameter, each characteristic line showing the relation between the physique of the bolt and the environmental temperature regarding the criterion value ($vE_{ave}$=27 [J]), the bolt being manufactured through water quenching in the event of hardening.

In FIG. 2, the minimum temperatures at which the Charpy impact value of the test piece from each bolt, which is manufactured through the process of rapid cooling in water, satisfy the criterion, in response to each J parameter, the temperatures being shown in a relation between the typical length of the bolt (the lateral axis) and the temperature (the vertical axis). In other words, the temperature of the vertical axis is the minimum temperature at which the Charpy impact value of the bolt material reaches the threshold value 27[J] in Charpy impact value $vE_{ave}$ with respect to the typical length in the lateral axis; thereby, the relation between the temperature and the typical length [in mm] are arranged along each J parameter.

As shown in FIG. 2, it is observed that the minimum temperature tends to increase as the typical length of the bolt becomes greater, along a constant J parameter, thereby the minimum temperature means a temperature at which the Charpy impact value of the test piece from each bolt satisfy the threshold 27 [J] in Charpy impact value $vE_{ave}$.

On the other hand, it is observed that the minimum temperature tends to increase as the j parameter increases when the typical length is kept at a constant value.

It is understood from FIG. 2 that the minimum temperatures for the bolts which typical lengths are smaller than or equal to 32 mm are lower than or equal to minus 20° C., under the condition that the J parameter is equal to 100; thereby, the minimum temperature being a temperature at which the Charpy impact value of the test piece from each bolt satisfies the threshold $vE_{ave}$=27 [J]. Hence, the bolts which typical lengths are smaller than or equal to 32 mm are usable for the cold climate condition, under the condition that the J parameter is equal to 100.

Further, it is understood that the minimum temperatures for all the bolts which typical lengths are within the interval from 28 to 40 mm are lower than or equal to minus 20° C., under the condition that the J parameter is equal to 200 or 300; thereby, the minimum temperature being a temperature at which the Charpy impact value of the test piece from each bolt satisfies the threshold $vE_{ave}$=27 [J]. Hence, it can be recognized that all the bolts which typical lengths are within the interval from 28 to 40 mm are usable for the cold climate condition, under the condition that the J parameter is equal to 200 or 300.

Further, when attention is paid to whether the rapid cooling in the steel hardening is performed in oil or water, it is understood that the approach of the rapid cooling in water tends to provide lower minimum temperature than the approach of the rapid cooling in oil, the minimum temperature being a temperature at which the Charpy impact value of the test piece from each bolt satisfies the threshold $vE_{ave}$=27 [J]; hereby, in comparison, the typical lengths of the bolts and the J parameters are supposed to be common.

For instance, with reference to FIGS. 1 and 2, the minimum temperature corresponding to a J parameter of 200 and the typical bolt length of 36 mm is minus 35° C. in the case of the bolt manufactured through the hardening with rapid cooling in oil (cf. FIG. 1), whereas the minimum temperature corresponding to the same conditions (J=200, the bolt size 36 mm) is minus 55° C. in the case of the bolt manufactured through the hardening with rapid cooling in water (cf. FIG. 2). Thus, it can be concluded that the hardening method with rapid cooling in water provides the bolt with more enhanced toughness than the hardening method with rapid cooling in oil.

The tendency that the hardening method with rapid cooling in water provides the bolt with more enhanced toughness than the hardening method with rapid cooling in oil can be observed regardless of the value of the J parameter or the typical length of the bolt. The reason is considered to be attributable to the fact that the comparatively quicker speed of the rapid cooling in water provides the hardened object further enhanced toughness than the comparatively slower speed of the rapid cooling in oil.

In the next place, the discussion will be continued about the adoption of the bolts which typical length is smaller than or equal to 36 mm, the adoption being related to the bolt used for the wind turbine installed in the cold climate areas; thereby, the J parameter is paid attention to.

Further, the data of the bolts which typical length is equal to 36 mm are paid attention to, out of the whole data of the bolts in FIG. 2 that shows the data in relation to the rapid cooling in water in the steel hardening. The study result of the discussion is summarized in FIG. 3.

Figure 3:
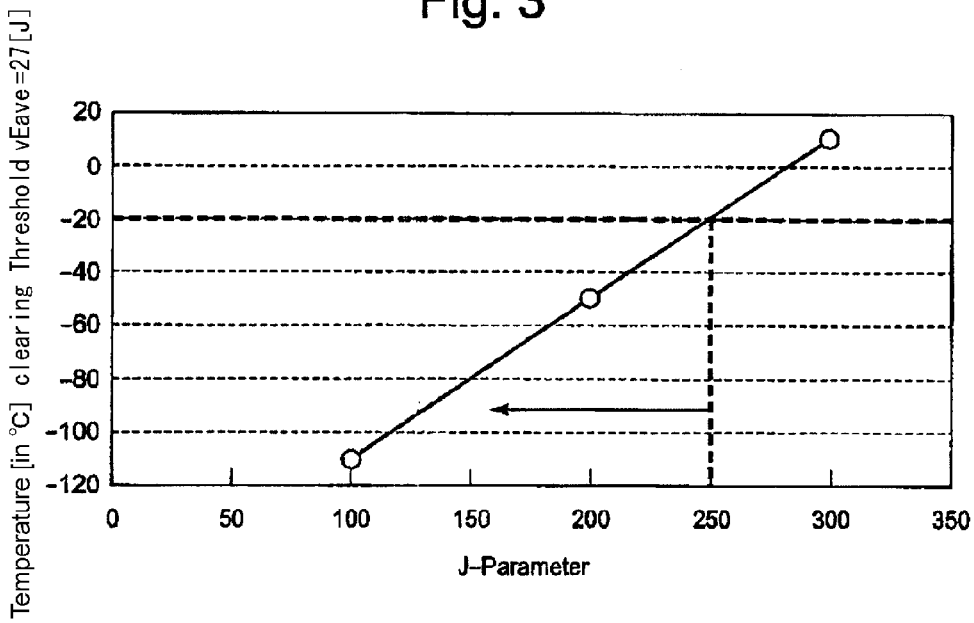
FIG. 3 shows the environmental temperature at which the Charpy impact value for the material of the bolt reaches the criterion value ($vE_{ave}$=27 [J]) with respects to J parameter; the lateral axis represents the J parameter; the vertical axis represents the environmental temperature regarding the criterion value ($vE_{ave}$=27 [J]); thereby, the bolt made of the chromium molybdenum steel is manufactured through water quenching in the event of hardening.

FIG. 3 shows a relation between the minimum temperature at which the Charpy impact value of the bolt satisfies the threshold $vE_{ave}$=27 [J], and the J parameter; thereby, the material of the bolt is the chromium molybdenum steel that is hardened with rapid cooling in water. In FIG. 3, the vertical axis and the lateral axis denote the minimum temperature [in ° C.] and the J parameter, respectively.

It is understood from FIG. 3 that the minimum temperature at which the Charpy impact value of the bolt satisfies the threshold $vE_{ave}$=27 [J] is in a linear relation with the J parameter; as the J parameter becomes greater, the minimum temperature at which the Charpy impact value of the bolt satisfies the threshold $vE_{ave}$=27 [J] becomes higher.

As described thus far, in a case of the wind turbine installed in the cold climate area where the ambient temperature becomes as low as minus 40° C., it is required that the Charpy impact value of the test piece from the bolt used in the wind turbine satisfy the criterion that the Charpy impact value be more than or equal to a threshold $vE_{ave}$=27 [J] in an atmosphere of minus 20° C. FIG. 3 relates to the data of the bolts which typical length is equal to 36 mm; further, in the hardening of the bolts, the rapid cooling in water is applied. Thereby, it is understood that the J parameter may be less than or equal to 250 so as to clear the criterion that the Charpy impact value be more than or equal to a threshold $vE_{ave}$=27 [J] in an atmosphere of minus 20° C.

Further, the bolts which typical length is smaller than 36 mm are taken into consideration. Since it is concluded from FIG. 2 that the toughness of the bolts which typical length is smaller than 36 mm is greater than that of the bolts which typical length is equal to 36 mm, all the bolts of the typical length smaller than 36 mm can clear the criterion that the Charpy impact value be more than the threshold $vE_{ave}$=27 [J] in an atmosphere of minus 20° C., under the condition that the J parameter is less than or equal to 250; namely, in a case where the maximum typical length of the bolts used in the wind turbine installed in the cold climate area does not exceeds 36 mm, the bolts can be used as a bolt for the cold climate condition regardless the size of the bolt, under the condition that the J parameter is less than or equal to 250, the condition as to the J parameter satisfying the criterion that the Charpy impact value be more than the threshold $vE_{ave}$=27 [J] in an atmosphere of minus 20° C.

Thus, since the maximum typical length of the manufactured bolts is known to be smaller than or equal to a certain length, it becomes unnecessary to check the size from a bolt to a bolt; further, the J parameter can be calculated, if the content ratios [in mass %] regarding the four elements Si, Mn, P, and Sn in the steel material are known; thus, it can be judged whether or not a bolt can be usable for the wind turbine installed in the cold climate areas. Hereby, it is especially noted that the content ratios [in mass %] regarding the four elements Si, Mn, P, and Sn in the steel material are described in the steel material inspection certificate to be submitted; thus, it is unnecessary for the manufacturer of the wind turbine or the manufacturer of the bolts to analyze the content ratios regarding the four elements Si, Mn, P, and Sn in the steel material.

In addition, the above-described length 36 mm as a maximum typical length regarding the bolts that are used for the wind turbine installed in the cold climate areas is simply an example length; the maximum typical length can be a length other than 36 mm; thereby, as is the case with FIG. 3 in which an upper-limit 250 regarding the J parameter is established with respect to the maximum typical length 36 mm as an example length, another upper-limit regarding the J parameter can be established with respect to another maximum typical length. In this way, by investigating the J parameter as to the steel material of the bolt, it can be judged whether or not the bolt can be usable for the wind turbine installed in the cold climate areas.

Incidentally, as a matter of course, another upper-limit regarding the J parameter has to be established in the case where the steel material hardened with rapid cooling in not water but oil.

In the next place, a bolt inspection method for inspecting bolts used in a wind turbine installed in cold climate areas is explained; thereby, the material of the bolts is the chromium molybdenum steel that is hardened with rapid cooling in water; the maximum typical length of the bolt is 36 mm; and, the requirement criterion for the bolts is that the Charpy impact value be more than the threshold $vE_{ave}$=27 [J] in an atmosphere of minus 20° C.

Figure 4:
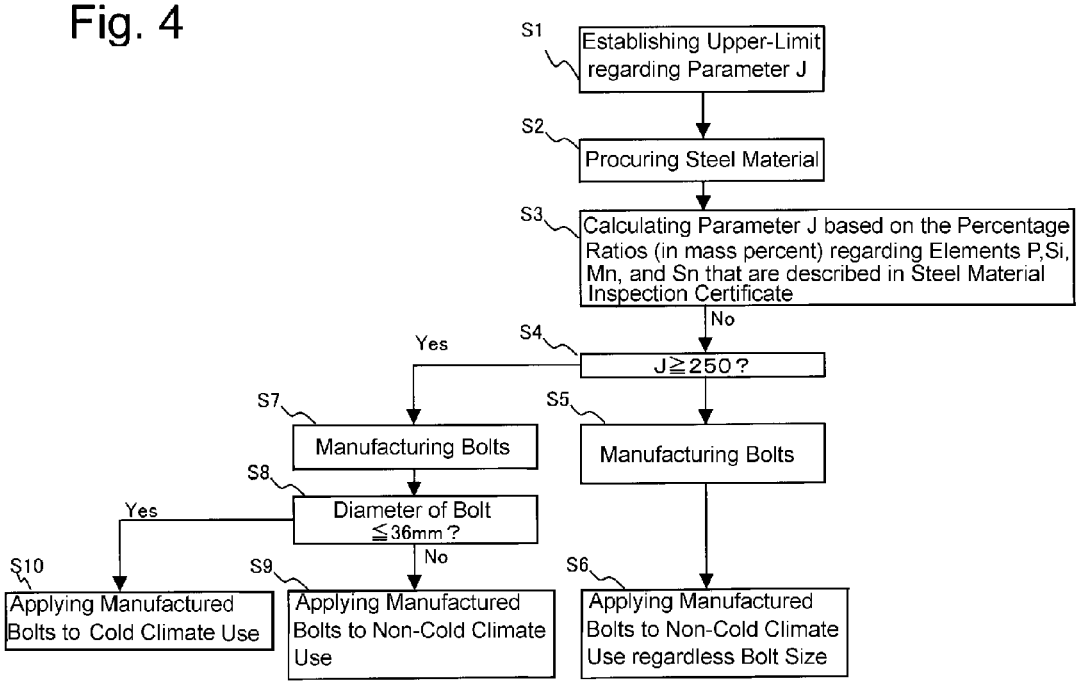
FIG. 4 shows the flow chart of the steps of the bolt inspection process according to the embodiment of the present invention.

FIG. 4 shows the flow chart of the steps of the bolt inspection process according to the embodiment of the present invention.

Firstly, in the step S1, an upper-limit regarding the J parameter is established; hereby, as explained by FIG. 3, the upper-limit is 250 (J=250).

The step S1 is followed by the step S2 where the steel material (namely, the chromium molybdenum steel) of the bolts is procured; the steel material is usually procured from a steel material manufacture; in procuring the steel material, it is necessary to make certain that the steel material inspection certificate in which the content ratios [in mass %] regarding the four elements Si, Mn, P, and Sn in the steel material are described is provided together with the steel material.

After the steel material and the certificate are obtained in the step 2, the value of the J parameter is calculated on the basis of the content ratios [in mass %] regarding the four elements Si, Mn, P, and Sn, the content ratios being described in the steel material inspection certificate; further, in the following step S4, it is judged whether or not the value of the J parameter is not less than 250 (i.e. J≥250).

If the judgment result in the step S4 is NO, then the step 4 is followed by the step 5; since the judgment result in the step S4 is NO, the corresponding bolt material (as a bolt raw material) is unusable for the cold climate condition; although the bolt is manufactured from the raw material, the manufactured bolt is applied to the non-cold climate use in the step S6, regardless of the size of the bolt.

If the judgment result in the step S4 is YES, then the step 4 is followed by the step 7 in which the bolt is manufactured.

The step S7 is followed by the step S8 in which the size (the typical length) of the bolt manufactured in the step S7 is measured; and, it is judged whether or not the bolt size is smaller than or equal to 36 mm.

If the judgment result in the step S8 is NO, then the step 8 is followed by the step 9; since the judgment result in the step S8 is NO, the corresponding bolt manufactured in the step S8 does not satisfy the requirement that the bolt be usable for the cold climate condition, from the view point of the size of the bolt; thus, in the step S9, the manufactured bolt is applied to the non-cold climate use.

Further, if the judgment result in the step S8 is YES, then the bolt manufactured in the step S8 is applied to the cold climate use.

As described thus far, by establishing the upper-limit regarding the J parameter in advance, as well as, by calculating the J parameter by use of the data regarding the content ratios [in mass %] of the four elements Si, Mn, P, and Sn the data which are described in the steel material inspection certificate, it is easily judged whether or not the manufactured bolt is usable for the cold climate condition.

Further, since the data regarding the content ratios that are described in the steel material inspection certificate can be made use of, it is unnecessary to analyze the supplied steel material.

In addition, the value as to the J parameter can be calculated at the time point when the steel materials (the raw materials) of the bolts are supplied before the bolts are manufactured (processed); thus, at the time point when the steel materials of the bolts are supplied, namely, in the stage of the steps S1 to S4 in FIG. 4, it is judged whether or not the supplied raw materials for the bolts are usable for the cold climate condition, from the view point regarding material toughness. Hence, at the time point of the material procurement, the ratio regarding of the bolts to be usable for the cold climate condition to the whole manufactured bolts can be estimated. Accordingly, additional order for the bolt material can be easily placed on as needed; thus, the possibility that the number of the bolts to be usable for the cold climate condition does not reach a necessary number can be reduced.

Industrial Applicability

The present invention discloses a bolt inspection method for inspecting the bolt made of chromium molybdenum steel whereby it can be judged whether or not the bolt is usable in the wind turbine installed in cold climate areas, without performing Charpy impact tests accompanying intricate work processes; thus, the manufactured bolts can be classified into the cold climate use and the non-cold climate use.

The invention claimed is:

1. A bolt inspection method for inspecting a bolt which is manufactured through heat treatment and made of chromium molybdenum steel, thereby the bolt is manufactured through heat treatment process and it is judged judging whether or not the bolt, has Charpy impact strength of more than or equal to 27[J] with respect to a condition of minus 20° C., without performing Charpy impact test, the method comprising the steps of:

manufacturing, through heat treatment, a bolt made of chromium molybdenum steel calculating J parameter that is expressed in a formula, $$J=(\text{Si }\%+\text{Mn }\%)\times(\text{P }\%+\text{Sn }\%)\times 10^4$$

by use of Si %, Mn %, P %, and Sn % denoting silicon percentage content, manganese percentage content, phosphorus percentage content and tin percentage content in mass %, respectively, each percentage content in the chromium molybdenum steel being described in a steel material inspection certificate, and judging whether or not the bolt has Charpy impact strength of more than or equal to 27[J] with respect to a condition of minus 20° C., by use of the calculated J parameter and a diameter at a typical length of a shaft part of the bolt.

2. The bolt inspection method according to claim 1, the method further comprising:

calculating an upper-limit regarding the J parameter based on the formula described in claim 1, and judging whether or not each bolt having the J parameter smaller than or equal to the calculated upper-limit, and the diameter of the shaft part of the bolt smaller than or equal to a maximum diameter regarding the bolts, is usable for a cold climate condition, wherein a lower-limit temperature for using the bolts is lower or equal to minus 20° C.

3. The bolt inspection method according to claim 2, the heat treatment process comprising:

rolling the chromium molybdenum steel;

elongating the chromium molybdenum steel after softening the chromium molybdenum steel, so as to form a shape of bolts;

hardening the chromium molybdenum steel by rapid cooling in oil or water after heating the steel; and annealing the chromium molybdenum steel to slowly cool the steel after re-heating the steel and keeping a re-heated temperature for a predetermined time span;

wherein the upper-limit regarding the J parameter in a case the hardening is performed with the rapid cooling in oil is established to be higher than the upper-limit regarding the J parameter in a case the hardening is performed with the rapid cooling in water.

4. The bolt inspection method according to claim 2, wherein the upper-limit is 250.

5. The bolt inspection method according to claim 2, wherein the maximum diameter is 36 mm.

* * * * *